United States Patent [19]

Millhimes et al.

[11] Patent Number: 4,474,417

[45] Date of Patent: Oct. 2, 1984

[54] MATEABLE ELECTRICAL CONNECTORS

[75] Inventors: Wayne L. Millhimes, Hershey; Daniel J. Murren, Dillsburg; John R. Nemcovsky, Hummelstown, all of Pa.

[73] Assignee: AMP Incorporated, Harrisburg, Pa.

[21] Appl. No.: 433,194

[22] Filed: Oct. 7, 1982

[51] Int. Cl.[3] ..... H01R 11/00

[52] U.S. Cl. ..... 339/59 M; 339/217 S; 339/258 F

[58] Field of Search ..... 339/59 R, 59 M, 276, 339/217 S, 258 F, 258 S

[56] References Cited

U.S. PATENT DOCUMENTS

| | | | |
|---|---|---|---|
| 2,838,739 | 6/1958 | Winkler | 339/47 R |
| 3,065,443 | 11/1962 | Hopkins et al. | 339/258 S |
| 3,259,870 | 7/1966 | Winkler | 339/49 R |
| 3,794,957 | 2/1974 | Winkler | 339/49 R |
| 3,808,578 | 4/1974 | Hansen | 339/59 M |
| 3,944,312 | 3/1976 | Koenig | 339/59 R |
| 3,971,613 | 7/1976 | Kobler | 339/59 R |
| 4,030,804 | 6/1977 | Enomoto | 339/258 S |
| 4,046,452 | 9/1977 | Cassarly | 339/198 H |
| 4,127,314 | 11/1978 | Hasimoto | 339/59 M |
| 4,139,255 | 2/1979 | Otani | 339/217 S |
| 4,150,863 | 4/1979 | Krafthefer | 339/17 LC |
| 4,402,564 | 9/1983 | Frantz | 339/176 MF |

*Primary Examiner*—John McQuade
*Assistant Examiner*—Paula Austin
*Attorney, Agent, or Firm*—Allan B. Osborne

[57] ABSTRACT

The present invention relates to mateable electrical connectors of the type wherein housings of insulating material carry within terminals of conductive material. Upon the connectors being telescopingly mated, the terminals slidingly engage and are pressed together by a biasing member on one of the two terminals.

2 Claims, 8 Drawing Figures

MATEABLE ELECTRICAL CONNECTORS

U.S. Pat. No. 2,838,739 describes an electrical connector comprising a housing of insulating material and carrying within a terminal, said connector being adapted for longitudinal telescoping engagement with a second and identical connector. The terminal is provided with a cylindrical wire barrel at one end to receive an end of a wire. A contacting portion at the opposite end includes an elongated flat portion having a convex or rounded boss on one surface adjacent the free end. An outwardly curved leaf spring is attached to the flat portion on the side opposite the rounded boss. With the terminal in the housing, the spring, bearing against one wall of the housing, biases the boss hard against the flat portion on a like terminal mated therewith. The connectors are of the hermaphroditic type; i.e., the terminals and housings are identical, interchangeable and intermateable.

The present invention is intended to provide an electrical connector system comprising a pair of connectors adapted for longitudinal telescoping engagement with one another but with each connector being unique relative to the other.

The mateable electrical connectors are, according to the present invention, characterised in consisting of a female and a male housing and a male terminal positioned in the female housing and a female terminal positioned in the male housing with each terminal and housing having cooperating parts to secure the terminal within the housing against side and longitudinal movement. Further, an integral spring member on the female terminal provides a high engagement force between the female and male terminals totally independent of the housing.

The state of the art at this time is further exemplified by U.S. Pat. Nos. 3,259,870, 3,794,957 and 4,046,452.

For a better understanding of the invention, reference will now be made by way of example to the accompanying drawings, in which.

Figure 1:
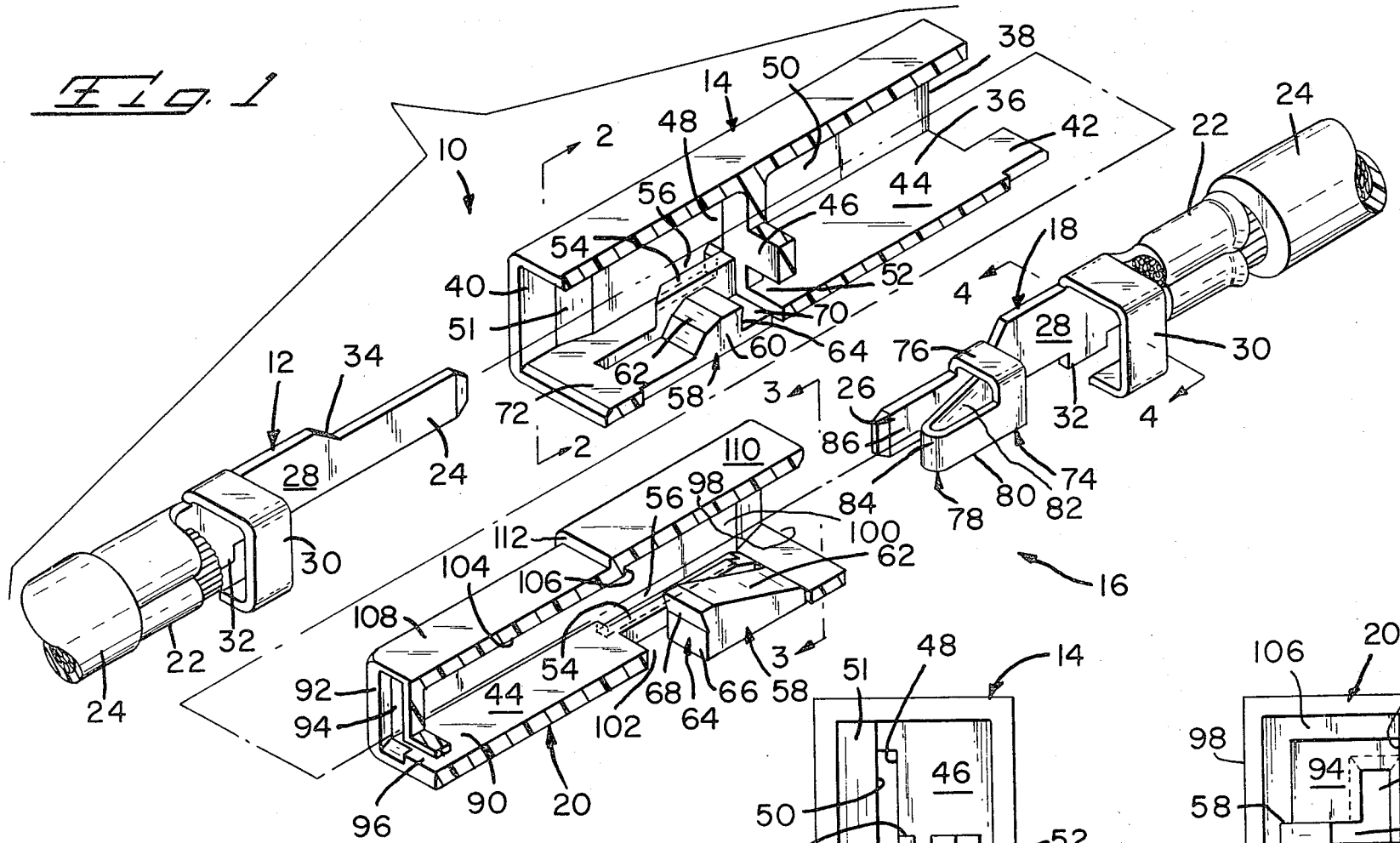
FIG. 1 is an isometric, exploded view, with the housings sectioned, of the mateable electrical connectors of the present invention.

The electrical connectors of the present invention includes two mateable connectors with each connector including a housing made of an insulating material and a terminal made of a conducting material. Thus, the complete connection has four basic elements which are shown isometrically in FIG. 1 to which reference will now be made as well as to FIGS. 2, 3 and 4.

The first connector, indicated generally by reference numeral 10, consists of male terminal 12 and female housing 14. The second connector, indicated generally by reference numeral 16, consists of female terminal 18 and male housing 20.

Figure 4:
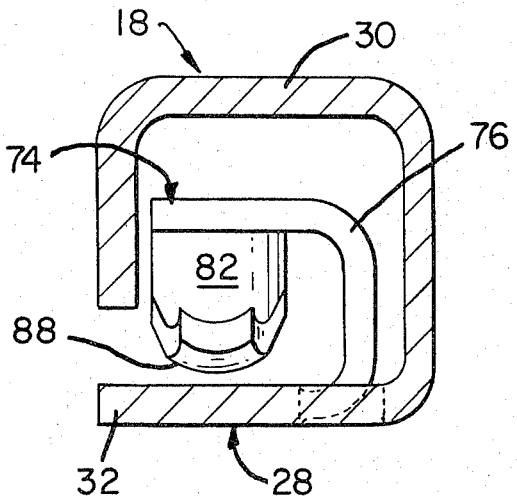
FIG. 4 is a view, taken along line 4—4 in FIG. 1, looking forward along the axis of the female terminal of the present invention.

Male terminal 12 includes wire securing means 22 at the back end which, in the drawing, is an open barrel type whose sides have been crimped down around wire 24. The front end of the terminal is flat tab 26 with the free or leading tip preferrably being beveled as shown. Intermediate the two ends and joining them is retention portion 28. Included in the retention portion is retention beam 30 which is attached to one edge and extends up (relatively speaking) from that edge, over the body of the retention portion and back down towards the opposite edge. FIG. 4 shows the configuration of the beam clearly. The free end of beam 30 stops short of contacting the opposite edge so that the beam is U-shaped with asymmetrical legs.

The aforementioned opposite edge is the lateral edge of ear 32 which is attached to and projects out from the body of retention portion 28.

Tab 26 is narrower than retention portion 28 with the change in width being indicated by reference numeral 34. Conductivity is not effected by the reduced area provided the terminal is made from a preferred iron copper material and sufficient force is available to press the contacting tabs together.

Female housing 14 in which male terminal 12 is positioned, is preferrably molded from a polycarbonate sold by General Electric Company under the trade name of LEXAN. A passage 36 extends longitudinally through the housing with entrance 38 and rear entrance 40 providing access thereto. A projection, hereinafter referred to as "cover 42", projects forwardly from its attachment to passage floor 44 and extends beyond front entrance 38.

Transverse wall 46, located intermediate the two openings, divides passage 36 into front and rear sections with a vertical slot 48 in the wall providing an opening between the two sections. As between the two sections, the width of the rear one is less by reason of sidewall 50 being thicker as indicated by beveled vertical surface 51 near rear entrance 40. The thicker sidewall provides one side of slot 48. The passage in the front section widens out immediately in front of transverse wall 46 so that there is a space between the edge of the slot and the sidewall and which is substantially equal to the thickness of tab 26 plus the thickness of the sidewall of male housing 20.

An opening 52 seen in transverse wall 46 is for a molding core pin and has no other function. A low, vertical wall 54 extends rearwardly from transverse wall 46 to define, in cooperation with sidewall 50, upwardly open groove 56. The groove is in alignment with vertical slot 48 with the floor of the slot somewhat below the top of vertical wall 54.

A portion of floor 44 behind transverse wall 46 if formed into a hinged retention member 58. This member includes a boss 60 extending up into passage 36 and having a rearwardly facing, slanted surface 62 and a forwardly facing shoulder 64. The shoulder, extending transversely into the passage, as shown more clearly in the sectioned male housing 20, consists of a lower vertical section 66 and an upper inclined section 68. The boss is spaced back from the transverse wall to define in cooperation therewith, beam 30 receiving space 70. Retention member 58 is hinged by cuts through passage floor 44 on three sides with the fourth, uncut side, indicated by reference numeral 72, being the hinge.

Female terminal 18 is substantially the same as male terminal 12 except for the addition of biasing member 74. The parts of this terminal which are identical to male terminal 12 carry the same reference numerals.

Biasing member 74 consists of a strap 76 which is attached to one edge of tab 26 and extends up (relatively speaking) from that edge and over the body of the tab. A cantilever beam 78 is attached to the free end of the strap and is generally V-shaped as viewed from a side. A first leg 80 extends forwardly from its attachment to the free end of strap 76. A second leg 82 extends downwardly towards tab 26 and rearwardly towards retention portion 28. Bight 84 joins the two legs. A space, indicated by reference numeral 86 is defined between tab 26 and second leg 82. The second leg is formed so that its outer surface; i.e., the surface facing tab 26, is curved or rounded from edge to edge. FIG. 4 shows this curved surface which is indicated by reference numeral 88 in that drawing.

Leg 82 flexes about bight 84 and the entire beam flexes about the attachment point with strap 76.

Female terminal 18 is also preferrably stamped and formed from iron copper.

Male housing 20 is preferrably molded from polycarbonate.

Some of the features therein are nearly identical and provide the same functions as in female housing 14. Accordingly, the reference numbers used with respect to housing 14 will be used in the description of housing 20. Specifically, these features include low vertical passage floor 44, wall 54, groove 56 and retention member 58. However, other features which have identical functions; e.g., the passage through the housing, having different reference numerals to avoid confusion.

Passage 90, extending through the male housing, is accessible at the front end through front wall 92 by narrow vertical slot 94. The horizontal opening 96 is for core pin access.

Low vertical wall 54 on passage floor 44 and near rear entrance 98, defines in cooperation with the adjacent sidewall 100 upwardly open groove 56. Hinged retention member 58 lies adjacent low vertical wall 54 and includes the same components as that member in the female housing. An opening 102 is provided through passage floor 44 immediately in front of forwardly facing shoulder 64. The top wall 104 of passage 90 is vertically stepped to provide a rearwardly facing shoulder 106. This shoulder is aligned with the front edge of opening 102 so that a beam receiving space between that shoulder and shoulder 64 is provided.

The outside of housing 20 includes a front section 108 and rear section 110 with the front section being smaller in size as indicated by the forwardly facing shoulder 112. The width and thickness of this front section is such that it can conformably enter into passage 36 in female housing 14 through front entrance 38.

Figure 3:
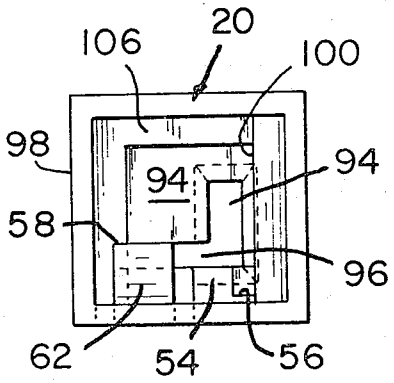
FIG. 3 is an end view, taken along line 3—3 in FIG. 1, looking into the male housing of the present invention.
Figure 2:
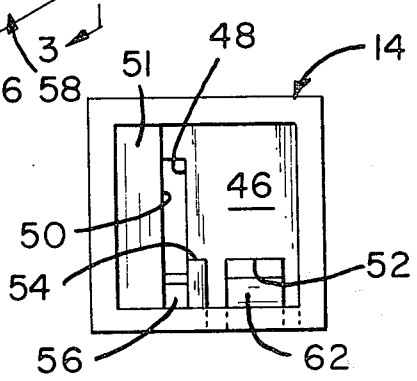
FIG. 2 is an end view, taken along line 2—2 in FIG. 1, looking into the female housing of the present invention.

FIGS. 2 and 3 are views looking into housings 14 and 20 respectively from the rear entrances. Similarly, FIG. 4 is a view looking forwardly along female terminal 18 from behind retention portion 28.

Figure 5:
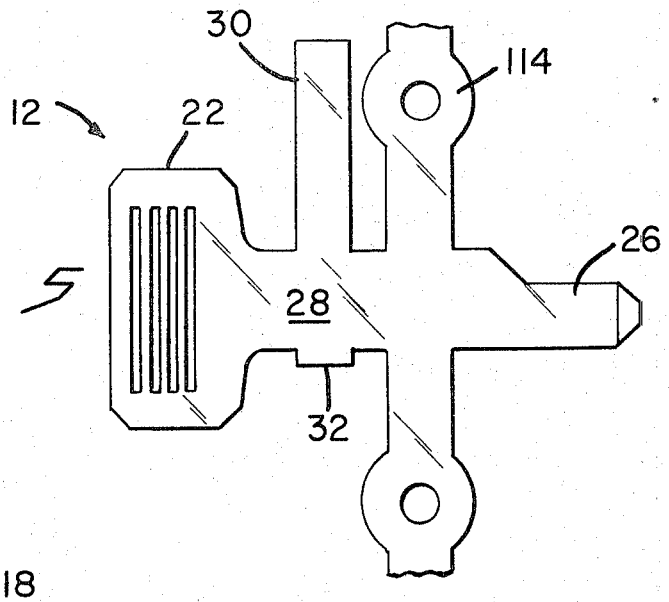
FIG. 5 is a top plan view of a stamped but not yet formed up male terminal of the present invention.
Figure 6:
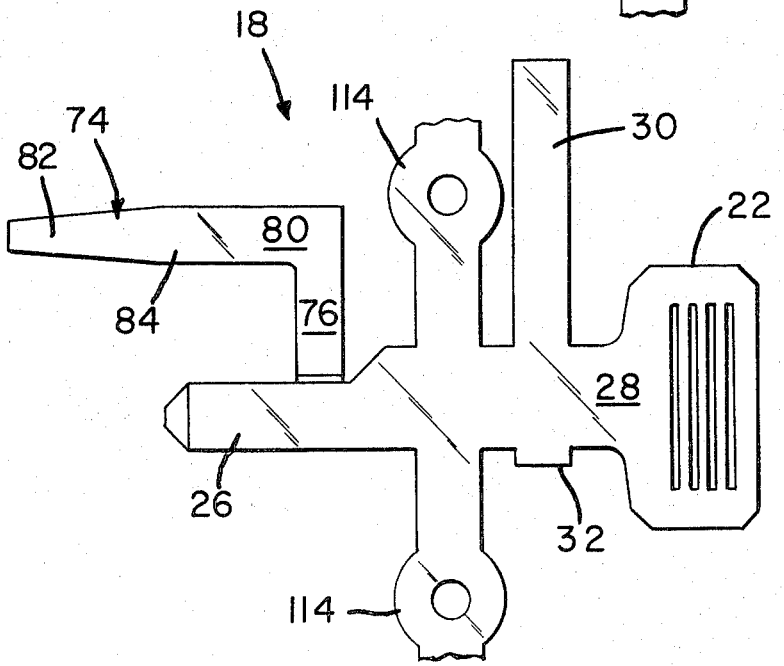
FIG. 6 is a top plan view of a stamped but not yet formed up female terminal of the present invention.

FIGS. 5 and 6 are top plan views of male and female terminals 12 and 18 respectively after being stamped out from coplanar stock but before forming. The reference numerals are the same as for the formed terminals shown in FIG. 1 for component identity. The terminals are preferrably stamped and formed on a continuous carrier strip, a practice well known in the art. Portions of the carrier strip are shown and indicated by reference numeral 114.

Figure 7:
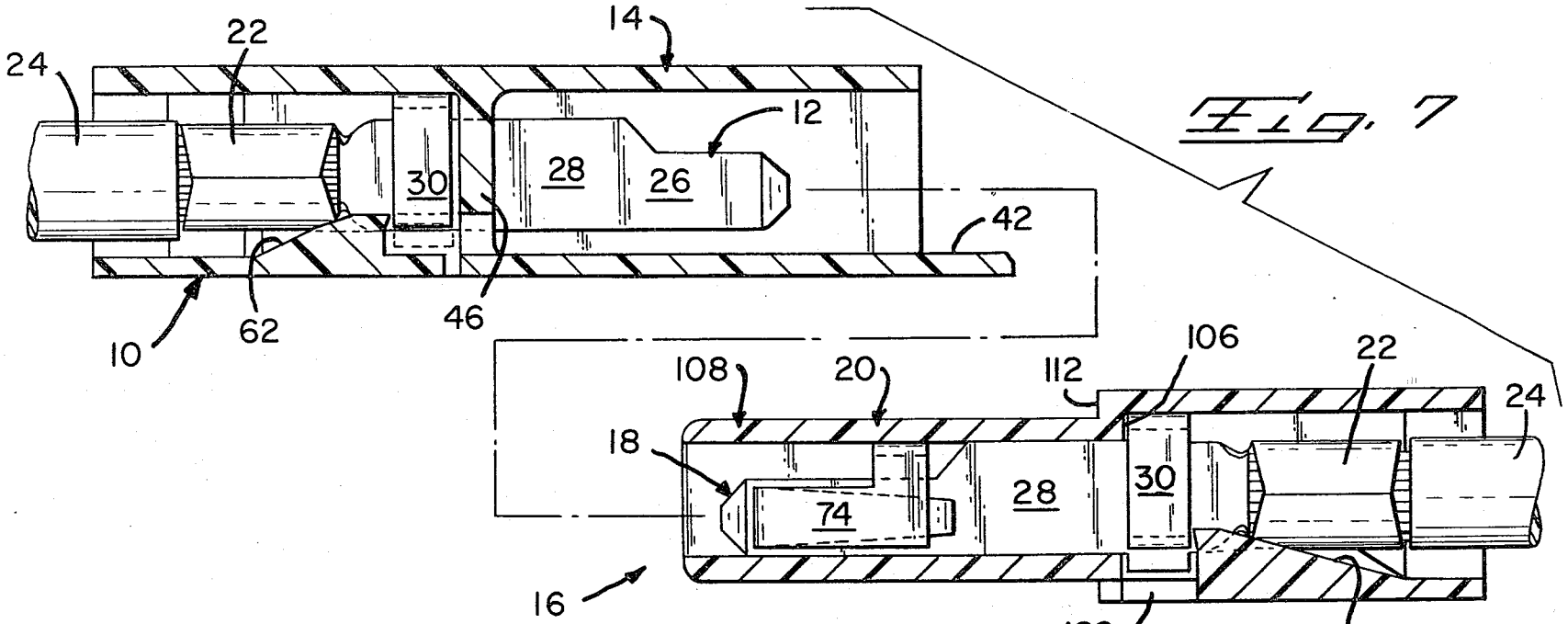
FIG. 7 is a longitudinal cross-sectional view of the assembled connectors of the present invention.

FIG. 7 are side views of units 10 and 16 with the housings sectioned to show the positioning of the terminals therein. In both units, as the terminals are inserted into the passages from the rear entrances, beams 30 contact slanted surfaces 62 and force retention members 58 downwardly to allow the beams to pass into the space directly in front of forwardly facing shoulders 64. The retention members return to their original location, as shown in FIG. 7 to block the withdrawal of the terminals. The upper inclined section on the shoulders prevent rearward motion by the terminals from working retention members 58 downwardly. Further forward travel is blocked by transverse wall 46 in housing 14 and rearwardly facing shoulder 106 in housing 20. The tab and forward part of retention portion 28 on male terminal 12 have passed through transverse wall 46 via vertical slot 48. Ears 32 are positioned in grooves 56 to prevent sideways motion of the terminals.

Figure 8:
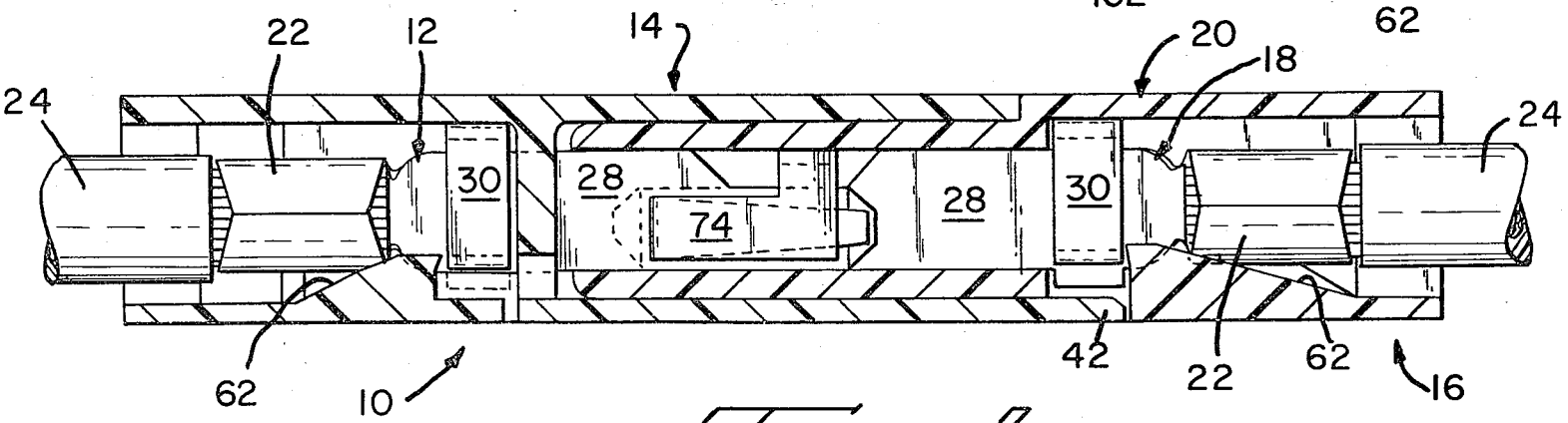
FIG. 8 is a longitudinal, cross-sectional view of the mated connectors of FIG. 7.

FIG. 8 shows the two units mated so that current can pass from one wire 24 to the other wire. The front section 108 of housing 20 of unit 16 enters into housing 14. Concurrently, tab 26 on male terminal 12 enters housing 20 through slot 94 and slides along the surface of tab 26 on female terminal 18 and into space 86 defined by the tab and second leg 82 on cantilever beam 78. Energy is stored in biasing member 74 both by deflecting second leg 82 in towards first leg 80 and by twisting strap 76 as the male tab is inserted. Thus, both the bending or deflecting of second leg 82 and the torsional energy from twisting strap 76 is available to forcefully hold the tabs against each other to provide electrical contact therebetween. With the two units joined, cover 42 covers opening 102.

We claim:

1. Mateable electrical connectors comprising:

a. a first connector including:

i. a female housing having a passage therethrough with a transverse barrier wall intermediate the ends of the female housing with the passage being reduced to a slot therethrough, a retention member having a shoulder extending transversely into the passage and spaced from the transverse wall to define a space therebetween, and a low, vertical, wall extending longitudinally along the floor of the passage so as to define, in cooperation with a wall of the passage, a groove, said groove being in alignment with the slot through the transverse wall, and ii. an elongated male terminal having wire securing means at the back end, an elongated flat first tab at the front end and a retention portion intermediate the two ends with a retention beam attached to one edge and extending over the portion and further an ear attached to and projecting laterally from the opposite edge, said male terminal being positioned in the female housing with the first tab extending through the slot in the transverse wall, the ear positioned in the longitudinal groove to prevent transverse motion and the beam positioned in the space between the transverse wall and the transversely extending shoulder to hold the terminal against longitudinal motion; and b. a second connector including:

i. a male housing having a passage therethrough, a retention member having a first shoulder extending transversely into the passage intermediate the ends of the male housing, a second shoulder spaced from and facing the first shoulder to define a space therebetween, and a lower vertical wall extending longitudinally along the floor of the passage to define, in cooperation with a wall of the passage, a groove, said male housing adapted for being telescopingly received into the passage in the female housing; and an elongated female terminal having wire securing means at the back end, an elongated flat second tab at the front end, a retention portion intermediate the two ends with a retention beam attached to one edge and extending over the portion, an ear attached to and projecting laterally from the opposite edge, and a biasing member comprising a strap attached to one edge of the second tab and extending up and over the second tab so that the free end of the strap is spaced thereabove, and a cantilever beam attached to the end of the strap and extending back down obliquely towards the second tab to define an opening therebetween, said female terminal being positioned in the male housing with the retention beam being received in the space between the first and second facing shoulders to prevent longituding movement and the ear received in the groove to prevent transverse motion, said connectors being mated to establish electrical connection therebetween by the male housing of the second connector being received telescopingly in the female housing of the first connector and the first tab being received in the opening defined by the second tab on the female terminal and the cantilever beam with the cantilever beam biasing the first tab against the second tab.

2. The connectors of claim 1 wherein the transversely extending shoulders include a lower vertical section and an upper inclined section.

* * * * *